US010614711B2

(12) United States Patent
Nordbruch

(10) Patent No.: US 10,614,711 B2
(45) Date of Patent: Apr. 7, 2020

(54) CONCEPT FOR MONITORING A PARKING FACILITY FOR MOTOR VEHICLES

(71) Applicant: Robert Bosch GmbH, Stuttgart (DE)

(72) Inventor: Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/315,709

(22) PCT Filed: Jun. 30, 2017

(86) PCT No.: PCT/EP2017/066271
§ 371 (c)(1),
(2) Date: Jan. 7, 2019

(87) PCT Pub. No.: WO2018/019513
PCT Pub. Date: Feb. 1, 2018

(65) Prior Publication Data

US 2019/0304305 A1 Oct. 3, 2019

(30) Foreign Application Priority Data

Jul. 29, 2016 (DE) ..... 10 2016 213 982

(51) Int. Cl.
*G08G 1/14* (2006.01)

(52) U.S. Cl.
CPC ..... *G08G 1/142* (2013.01)

(58) Field of Classification Search
CPC ..... G08G 1/142; G08G 1/147; G08G 1/148
See application file for complete search history.

(56) References Cited

U.S. PATENT DOCUMENTS 5,432,508 A * 7/1995 Jackson ..... E04H 6/42 340/932.2
6,285,297 B1 9/2001 Ball
2005/0285737 A1 12/2005 Kobayashi
2013/0099943 A1* 4/2013 Subramanya ..... G01S 13/10 340/933

(Continued)

FOREIGN PATENT DOCUMENTS

DE 102008017816 A1 10/2009
DE 102011052373 A1 2/2013

(Continued)

OTHER PUBLICATIONS

International Search Report for PCT/EP2017/066271, dated Sep. 7, 2017.

*Primary Examiner* — Phung Nguyen
(74) *Attorney, Agent, or Firm* — Norton Rose Fulbright US LLP; Gerard A. Messina

(57) ABSTRACT

A system for monitoring a parking facility for motor vehicles, including a radio transmitter for transmitting a radio signal with a predetermined level within the parking facility, a radio receiver for receiving the radio signal within the parking facility, a measuring device for measuring a level of the received radio signal, a processor for comparing the measured level to the predetermined level, the processor being designed to ascertain whether an object is located within the parking facility, based on the comparison. A corresponding method, a parking facility for motor vehicles, as well as a computer program are also described.

10 Claims, 1 Drawing Sheet

(56) References Cited

U.S. PATENT DOCUMENTS

| | | | | |
|---|---|---|---|---|
| 2014/0005961 | A1* | 1/2014 | Hod | G01S 15/04 702/56 |
| 2014/0210646 | A1* | 7/2014 | Subramanya | B61L 29/28 340/928 |
| 2016/0133125 | A1* | 5/2016 | Sandbrook | G01V 3/12 340/933 |

FOREIGN PATENT DOCUMENTS

| | | | |
|---|---|---|---|
| DE | 102013222071 | A1 | 4/2015 |
| EP | 1986173 | A1 | 10/2008 |
| EP | 2591465 | A1 | 5/2013 |

* cited by examiner

CONCEPT FOR MONITORING A PARKING FACILITY FOR MOTOR VEHICLES

FIELD

The present invention relates to a system for monitoring a parking facility for motor vehicles. The present invention relates to a method for monitoring a parking facility for motor vehicles. The present invention also relates to a parking facility for motor vehicles. The present invention relates to a computer program.

BACKGROUND INFORMATION

German Patent Application No. DE 10 2013 222 071 A1 describes a parking-area management system.

SUMMARY

An object of the present invention may be seen in providing efficient monitoring of a parking facility for motor vehicles.

This objective may be achieved with the aid of the present. Advantageous developments of the present invention are described herein.

According to one aspect of the present invention, a system is provided for monitoring a parking facility for motor vehicles, including:

- a radio transmitter for transmitting a radio signal with a predetermined level within the parking facility,
- a radio receiver for receiving the radio signal within the parking facility,
- a measuring device for measuring a level of the received radio signal,
- a processor for comparing the measured level to the predetermined level,
- the processor being designed to ascertain whether an object is located within the parking facility, based on the comparison.

According to another aspect of the present invention, a method is provided for monitoring a parking facility for motor vehicles using the system for monitoring a parking facility for motor vehicles, the radio transmitter and the radio receiver being set apart from each other within the parking facility, including the following steps:

- Transmission of a radio signal by the radio transmitter,
- Reception of the radio signal by the radio receiver,
- Measurement of a level of the received radio signal by the measuring device,
- Comparison of the measured level to the predetermined level by the processor and
- Ascertainment by the processor whether, based on the comparison, an object is located within the parking facility.

According to another aspect of the present invention, a parking facility for motor vehicles is provided, including the system for monitoring a parking facility for motor vehicles.

According to a further aspect of the present invention, a computer program is provided which includes program code for carrying out the method for monitoring a parking facility for motor vehicles, when the computer program is executed on a computer.

The present invention is based on the knowledge that, solely by their presence, objects are able to influence or interfere with radio signals. Thus, a transmitted radio signal is not only able to get to and arrive at the radio receiver on a direct path. Rather, time-shifted echo signals reflected at an object may also arrive at the receiver. This results in a mingling of the direct radio signal with the various time-shifted, reflected echo signals. Generally, the level of this mixed radio signal is weaker than the level of the radio signal which arrives at the radio receiver on a direct path and without influencing or deflection or reflections.

This phenomenon is known as "multipath reception." That is, a multipath reception may thus occur at a radio receiver if electromagnetic waves (here the radio signal) of a radio transmitter are deflected by reflectors (here, for example, one or more objects) and arrive at the radio receiver by various paths. As already described above, this results in a mingling of the direct signal with the various time-shifted, reflecting echo signals. Generally, the level of this mixed signal is weaker than that of the direct path, which in English is also referred to as "multipath fading."

In other words, the radio signal which is sent out by the radio transmitter may get from the radio transmitter to the radio receiver on various paths. The reasons for this are, e.g., a reflection, a refraction, a scattering or a diffraction at one or more objects located in the propagation area of the radio signal.

Due to these transmission paths of various lengths, the radio signal may thus arrive repeatedly and in time-shifted manner at the radio receiver. The individual echo signals which appear at the radio receiver have different amplitudes and propagation times, depending on attenuation and distance traveled. As already described above, the level of the mixed signal is usually weaker than the level of the radio signal which has taken the direct path.

Therefore, based on the comparison of the measured level to the predetermined level, it is possible to ascertain efficiently and in advantageous manner whether an object is located within the parking facility.

If, for example, the measured level corresponds to the predetermined level, it may thus be assumed, for instance, that no object has influenced or interfered with the radio signal. Namely, it may therefore be determined that in this case, no object is located within the parking facility.

On the other hand, if the measured level is less than the predetermined level, it may then be assumed, namely, that one or more objects have influenced or interfered with the transmitted radio signal. Consequently, it may then be determined in advantageous manner, for example, that one or more objects are located within the parking facility.

Notably, attenuation of the radio signal, which always happens in reality even if no object influences or interferes with the radio signal, is also taken into account.

In particular, the more objects that are located within the parking facility and are able to influence or interfere with the transmitted radio signal, the greater the attenuation of the measured level relative to the predetermined level. Namely, a quantity of objects located within the parking facility may thus be ascertained.

This yields the technical advantage that an efficient concept is provided to efficiently monitor a parking facility for motor vehicles.

According to one specific embodiment of the present invention, in addition, one or more imaging sensors is/are provided to record sensor images of the parking facility, the processor being designed to ascertain whether an object is located within the parking facility, based on the recorded sensor images.

For example, this yields the technical advantage of providing an additional possibility for ascertaining whether an object is located within the parking facility. The parking facility may thus be monitored efficiently in advantageous manner.

By way of example, an imaging sensor is one of the following sensors: radar sensor, lidar sensor, video sensor, infrared sensor, ultrasonic sensor, magnetic sensor.

Thus, a radar sensor records a radar image. A lidar sensor thus records a lidar image. A video sensor thus records a video image. An infrared sensor thus records an infrared image. An ultrasonic sensor thus records an ultrasonic image. A magnetic sensor thus records a magnetic image. Sensor images are therefore, e.g., radar images, lidar images, video images, infrared images, ultrasonic images and/or magnetic images.

In one specific embodiment in accordance with the present invention, a plurality of imaging sensors are provided which, for example, are the same or different.

According to one specific embodiment in accordance with the present invention, the processor is further designed to compare a result of the ascertainment based on the comparison, to a result of the ascertainment based on the recorded sensor images or vice versa.

In particular, this brings about the technical advantage that the respective results are able to be checked efficiently against one another for plausibility or verified. Thus, if both results are the same, it may be assumed that an object is actually located within the parking facility. If the results are different, it is provided, for example, that the step of ascertainment based on the comparison and/or on the recorded sensor images be carried out again.

In one specific embodiment in accordance with the present invention, the processor is designed to ascertain whether an object is located within the parking facility based on the recorded sensor images only if the ascertainment based on the comparison has revealed that an object is located within the parking facility.

In particular, this provides the technical advantage that the monitoring may be carried out efficiently. A positive result of the ascertainment based on the comparison therefore triggers the step of the ascertainment based on the recorded sensor images, thus, initiates it.

A positive result of the ascertainment based on the comparison means that an object is located within the parking facility. The processor will thus analyze the recorded sensor images as to whether an object is located within the parking facility only if a result of the analysis of the level of the received radio signal is positive. Computing time may therefore be saved in advantageous manner.

According to one specific embodiment in accordance with the present invention, the processor is designed to compare the measured level to the predetermined level and to ascertain, based on the comparison, whether an object is located between the radio transmitter and the radio receiver only if the ascertainment based on the recorded sensor images has revealed that an object is located within the parking facility.

Specifically, this yields the technical advantage that the monitoring may be carried out efficiently. According to this specific embodiment, it is thus the case that a positive result of the ascertainment based on the recorded sensor images triggers or initiates the step of the ascertainment based on the comparison. A positive result of the ascertainment based on the recorded sensor images means that an object is located within the parking facility. The processor will thus analyze the measured level as to whether an object is located within the parking facility only if a result of the analysis of the sensor images is positive. Computing time may therefore be saved in advantageous manner.

In one specific embodiment in accordance with the present invention, the radio transmitter is designed to send out a WLAN signal as radio signal, the radio receiver being designed to receive the WLAN signal.

In particular, this brings about the technical advantage that, for example, a wireless communication is made possible with the aid of the WLAN signal.

For example, the radio transmitter is a WLAN device.

For example, the radio receiver is a WLAN device.

For example, a wireless communication network is established with the aid of the radio transmitter and with the aid of the radio receiver.

For example, the radio signal is a wireless communication signal.

For example, the radio signal is a WLAN radio signal.

For example, a WLAN communication network is established with the aid of the radio transmitter and with the aid of the radio receiver.

For example, the WLAN signal is a WLAN communication signal.

In particular, this means that a wireless communication network is therefore set up within the parking facility. For example, a WLAN communication network is established within the parking facility.

This means, namely, that a wireless communication is therefore permitted advantageously within the parking facility. In particular, a WLAN communication is permitted in advantageous manner within the parking facility.

Within the context of the wireless communication taking place, in addition to the communication, it is now provided, for example, to compare the level of the received communication signal to the predetermined level of the transmitted communication signal, it then being ascertained whether, based on the comparison, an object is located within the parking facility.

In addition to being used for the communication, a wireless communication infrastructure already existing in the parking facility may thus be used efficiently in advantageous manner to monitor the parking facility efficiently, especially to ascertain whether an object is located within the parking facility.

According to one specific embodiment in accordance with the present invention, the processor is designed to ascertain a quantity of objects located within the parking facility, based on the comparison.

In particular, this brings about the technical advantage that the number of objects located within the parking facility may be efficiently identified.

Specifically, the greater the number of objects that are located within the parking facility and are able to influence or interfere with the transmitted radio signal, the greater the attenuation of the measured level relative to the predetermined level. Namely, a quantity of objects located within the parking facility may thus be ascertained efficiently in advantageous manner.

According to one specific embodiment in accordance with the present invention, the processor is designed to ascertain a quantity of objects located within the parking facility based on the recorded sensor images, and to compare this quantity to the quantity of objects located within the parking facility ascertained based on the comparison.

Namely, this provides the technical advantage that the parking facility is able to be monitored efficiently. In particular, the respective results (the quantity of objects located within the parking facility ascertained in each case) may thus be checked efficiently against one another for plausibility or verified.

If the respective quantities are identical, it may be assumed that the result is correct. If, for instance, a different quantity of objects is ascertained, it is thus provided, for example, that the step of ascertainment based on the comparison and/or on the recorded sensor images be carried out again.

In one specific embodiment in accordance with the present invention, the system for monitoring a parking facility for motor vehicles is designed to implement or carry out the method for monitoring a parking facility for motor vehicles.

System features are derived analogously from corresponding method features and vice versa. Namely, that means therefore that technical functionalities of the system are derived from corresponding technical functionalities of the method and vice versa.

In another specific embodiment in accordance with the present invention, the processor is designed to guide a motor vehicle within the parking facility by remote control based on a result of the ascertainment based on the comparison and/or based on a result of the ascertainment based on the recorded sensor images. In particular, such a remote-controlled guidance of the motor vehicle includes pulling the motor vehicle into and/or out of a parking space. Thus, according to one specific embodiment, the processor is designed to operate a motor vehicle by remote control.

In another specific embodiment in accordance with the present invention, the processor is designed, based on a result of the ascertainment based on the comparison and/or based on a result of the ascertainment based on the recorded sensor images, to determine guidance data for a motor vehicle, based on which, a motor vehicle is able to drive autonomously within the parking facility. For instance, such guidance data include setpoint-trajectory data of a setpoint trajectory to be followed autonomously by the motor vehicle, map data of a digital map of the parking facility, and object data of objects located within the parking facility. Preferably, the guidance data are transmitted with the aid of a communication interface via a wireless communication network, to the motor vehicle. Thus, according to one specific embodiment, the processor is designed to determine guidance data for a motor vehicle.

For example, the wireless communication network is the wireless communication network described above, which is set up with the aid of the radio transmitter and radio receiver.

For instance, an object for the purpose of the present invention is a motor vehicle, a pedestrian, a cyclist or an animal. If the singular for "object" is used, the plural is always intended to be read at the same time and vice versa.

A parking facility in terms of the present invention may also be referred to as a parking area, and is used as parking for motor vehicles. Thus, in particular, the parking facility forms one cohesive area that has a plurality of parking spaces (in the case of a parking facility on private property) or parking stands (in the case of a parking facility on public property). According to one specific embodiment, the parking facility takes the form of a multi-level parking lot. According to one specific embodiment, the parking facility takes the form of a parking garage.

According to one specific embodiment of the present invention, the parking facility includes one or more imaging sensors.

According to one specific embodiment of the present invention, the parking facility includes one or more surroundings sensors for monitoring the parking facility. For example, a surroundings sensor in terms of this description is one of the following surroundings sensors: radar sensor, lidar sensor, video sensor, infrared sensor, ultrasonic sensor, magnetic sensor, photoelectric sensor.

Namely, this therefore provides the technical advantage that the parking facility is able to be monitored efficiently.

In particular, the formulation "and . . . , respectively" includes the formulation "and/or."

The present invention is explained in greater detail below on the basis of preferred exemplary embodiments.

DETAILED DESCRIPTION OF EXAMPLE EMBODIMENTS

Figure 1:
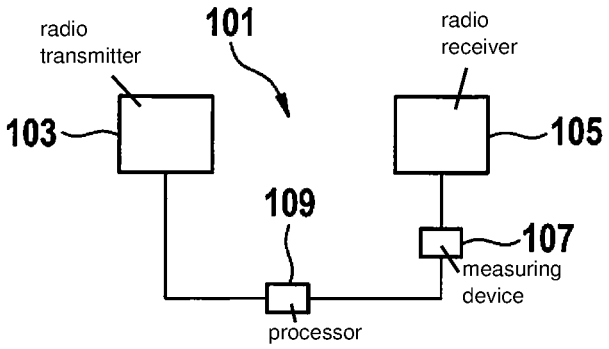
FIG. 1 shows a system for monitoring a parking facility for motor vehicles.

FIG. 1 shows a system 101 for monitoring a parking facility for motor vehicles as a schematic block diagram.

System 101 includes:

- a radio transmitter 103 for transmitting a radio signal with a predetermined level within the parking facility,
- a radio receiver 105 for receiving the radio signal within the parking facility,
- a measuring device 107 for measuring a level of the received radio signal,
- a processor 109 for comparing the measured level to the predetermined level,
- processor 109 being designed to ascertain whether an object is located within the parking facility, based on the comparison.

Radio transmitter 103 and radio receiver 105 are set apart from each other, in particular, are set apart from each other within the parking facility.

Figure 2:
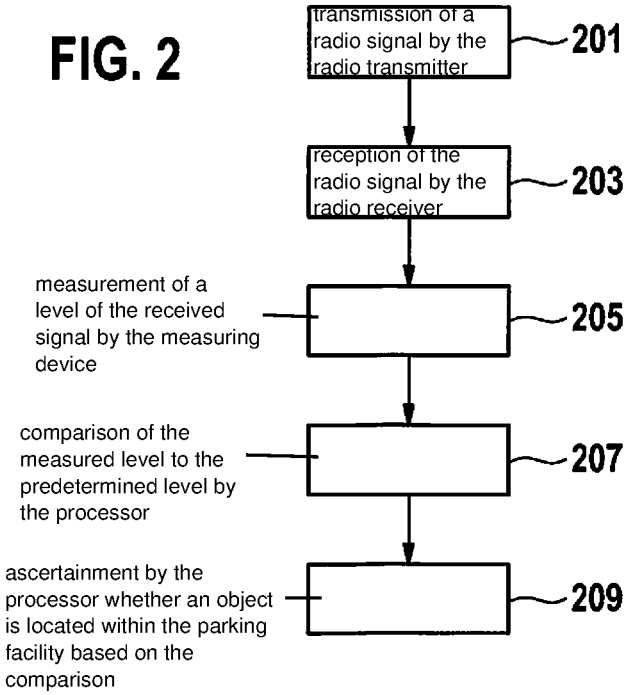
FIG. 2 shows a flowchart of a method for monitoring a parking facility for motor vehicles.

FIG. 2 shows a flowchart of a method for monitoring a parking facility for motor vehicles.

A system for monitoring a parking facility for motor vehicles as described above or below is used for the method, for example, system 101 according to FIG. 1 is used.

The method includes the following steps:

- Transmission 201 of a radio signal by the radio transmitter,
- Reception 203 of the radio signal by the radio receiver,
- Measurement 205 of a level of the received radio signal by the measuring device,
- Comparison 207 of the measured level to the predetermined level by the processor and
- Ascertainment 209 by the processor whether, based on the comparison, an object is located within the parking facility.

Figure 3:
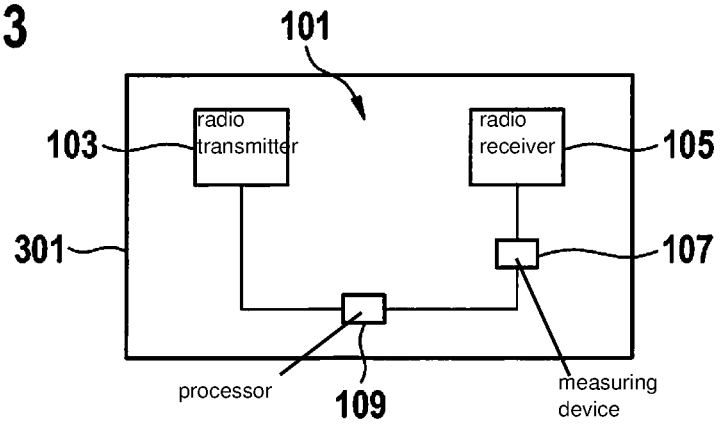
FIG. 3 shows a parking facility for motor vehicles.

FIG. 3 shows a parking facility 301 for motor vehicles.

Parking facility 301 includes system 101 of FIG. 1. Radio transmitter 103 and radio receiver 105 are set apart from each other within parking facility 301.

Thus, the present invention includes specifically and among other things the idea of verifying sensor images, which become or are recorded by one or more imaging sensors, using a radio signal, especially based on a measurement of a level of the received radio signal and based on a corresponding comparison to the predetermined level of the transmitted radio signal.

Generally, a wireless communication network is already set up within a parking facility. Notably, the present invention envisages here to use the wireless communication signals additionally for monitoring the parking facility. In other words, it is thus provided specifically to measure a level of a received communication signal and to compare the measured level to the predetermined level of the transmitted communication signal. In particular, it is provided to ascertain whether an object is located within the parking facility, based on the comparison.

That is, based on the communication signals which are WLAN communication signals, for example, it is thus possible to analyze, namely, whether persons are located or present within the parking facility and/or within a defined area of the parking facility. For example, a defined area is a parking level or a parking row.

This information or this result is then compared, e.g., to a result of the imaging sensor system, thus the imaging sensors.

In one specific embodiment of the present invention, a result of the ascertainment based on the sensor images is verified with a result of the ascertainment based on the comparison. That is, for example, after the result of the imaging analysis, the wireless communication infrastructure, which in particular includes the radio receiver and the radio transmitter, is thus asked for a verification or confirmation.

In one specific embodiment of the present invention, upon detection of an object, the wireless communication infrastructure triggers the imaging sensor system, thus, the imaging sensor(s). In particular, this is the case if the sensor system has not yet asked the wireless communication infrastructure for a verification of the sensor system's own result.

What is claimed is:

1. A system for monitoring a parking facility for motor vehicles, comprising:

a radio transmitter for transmitting a radio signal with a predetermined level within the parking facility;

a radio receiver for receiving the radio signal within the parking facility;

a measuring device for measuring a level of the received radio signal;

a processor for comparing the measured level to the predetermined level, wherein the processor is configured to ascertain whether an object is located within the parking facility based on the comparison; and one or more imaging sensors to record sensor images of the parking facility, the processor being configured to ascertain whether the object is located within the parking facility based on the recorded sensor images;

wherein it is verified that the object is located within the parking facility if it is ascertained that the object is located within the parking facility based on both the recorded sensor images and the comparison of the radio signals.

2. The system as recited in claim 1, wherein the processor is further configured to compare a result of the ascertainment based on the comparison to a result of the ascertainment based on the recorded sensor images.

3. The system as recited in claim 2, wherein the processor is configured to ascertain whether the object is located within the parking facility based on the recorded sensor images only if the ascertainment based on the comparison has revealed that the object is located within the parking facility.

4. The system as recited in claim 3, wherein the processor is configured to compare the measured level to the predetermined level and to ascertain, based on the comparison, whether an object is located between the radio transmitter and the radio receiver only if the ascertainment based on the recorded sensor images has revealed that the object is located within the parking facility.

5. The system as recited in claim 1, wherein the radio transmitter is configured to transmit a WLAN signal as the radio signal, and the radio receiver is configured to receive the WLAN signal as the radio signal.

6. The system as recited in claim 1, wherein the processor is configured to ascertain a quantity of objects located within the parking facility based on the comparison.

7. The system as recited in claim 6, wherein the processor is configured to ascertain the quantity of objects located within the parking facility based on the recorded sensor images, and to compare the quantity ascertained based on the recorded sensor images to the quantity of objects located within the parking facility ascertained based on the comparison.

8. A method for monitoring a parking facility for motor vehicles using a system including a radio transmitter, a radio receiver, a measuring device, and a processor, the method comprising:

transmitting a radio signal by the radio transmitter, wherein the system includes the radio transmitter for transmitting the radio signal with a predetermined level within the parking facility, the radio receiver for receiving radio signal within the parking facility, the measuring device for measuring the a level of the received radio signal, and the processor for comparing the measured level to the predetermined level, wherein the processor is configured to ascertain whether an object is located within the parking facility based on the comparison, the radio transmitter and the radio receiver being set apart from each other within the parking facility;

receiving the radio signal by the radio receiver;

measuring the level of the received radio signal by the measuring device;

comparing the measured level to the predetermined level by the processor;

ascertaining by the processor whether, based on the comparison, the object is located within the parking facility; and recording, via one or more imaging sensors, sensor images of the parking facility, the processor being configured to ascertain whether the object is located within the parking facility based on the recorded sensor images;

wherein it is verified that the object is located within the parking facility if it is ascertained that the object is located within the parking facility based on both the recorded sensor images and the comparison of the radio signals.

9. A parking facility for motor vehicles, comprising:

a system, within the parking facility, for monitoring the parking facility for the motor vehicles, including:

a radio transmitter for transmitting a radio signal with a predetermined level within the parking facility;

a radio receiver for receiving the radio signal within the parking facility;

a measuring device for measuring a level of the received radio signal;

a processor for comparing the measured level to the predetermined level, wherein the processor is configured to ascertain whether an object is located within the parking facility based on the comparison; and one or more imaging sensors to record sensor images of the parking facility, the processor being configured to ascertain whether the object is located within the parking facility based on the recorded sensor images;

wherein it is verified that the object is located within the parking facility if it is ascertained that the object is located within the parking facility based on both the recorded sensor images and the comparison of the radio signals.

10. A non-transitory computer readable storage medium on which is stored a computer program, which is executable by a processor, comprising:

a program code arrangement including program code for monitoring a parking facility for motor vehicles using a system including a radio transmitter for transmitting a radio signal with a predetermined level within the parking facility, a radio receiver for receiving the radio signal within the parking facility, a measuring device for measuring a level of the received radio signal, and the processor for comparing the measured level to the predetermined level, by performing the following:

ascertaining whether an object is located within the parking facility based on the comparison, the radio transmitter and the radio receiver being set apart from each other within the parking facility;

transmitting, via the radio transmitter, the radio signal;

receiving, via the radio receiver, the radio signal by the radio receiver;

measuring the level of the received radio signal by the measuring device;

comparing, via the processor, the measured level to the predetermined level;

ascertaining, via the processor, whether, based on the comparison, the object is located within the parking facility; and recording, via one or more imaging sensors, sensor images of the parking facility, the processor being configured to ascertain whether the object is located within the parking facility based on the recorded sensor images;

wherein it is verified that the object is located within the parking facility if it is ascertained that the object is located within the parking facility based on both the recorded sensor images and the comparison of the radio signals.

* * * * *